US006746212B2

(12) United States Patent
Payne

(10) Patent No.: US 6,746,212 B2
(45) Date of Patent: Jun. 8, 2004

(54) HIGH EFFICIENCY PUMP FOR LIQUID-COOLING OF ELECTRONICS

(75) Inventor: Dave A. Payne, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/103,975

(22) Filed: Mar. 22, 2002

(65) Prior Publication Data

US 2003/0180152 A1 Sep. 25, 2003

(51) Int. Cl.[7] ..... F04B 39/10; F04B 53/00
(52) U.S. Cl. ..... 417/53; 417/534
(58) Field of Search ..... 417/53, 534, 552, 417/553, 418, 417, 415; 361/699, 702, 687, 688, 689; 62/259.2

(56) References Cited

U.S. PATENT DOCUMENTS 3,591,003 A * 7/1971 Cooper ..... 210/90
4,272,226 A * 6/1981 Osborne ..... 417/418
4,692,673 A * 9/1987 DeLong ..... 318/132
4,698,728 A 10/1987 Tustaniwskyj et al.
5,779,455 A * 7/1998 Steiger ..... 417/418
5,899,672 A * 5/1999 Salamey ..... 417/418
5,907,473 A 5/1999 Przilas et al.
6,208,512 B1 * 3/2001 Goldowsky et al. ..... 361/699
6,361,288 B1 * 3/2002 Sperry ..... 417/307

FOREIGN PATENT DOCUMENTS

CH 630 443 A5 * 6/1982
DE 36 29 742 A1 * 3/1988
JP 05-126035 A * 5/1993

* cited by examiner

*Primary Examiner*—Justine R. Yu
*Assistant Examiner*—Han L Liu
(74) *Attorney, Agent, or Firm*—David N. Tran

(57) ABSTRACT

An apparatus includes a housing and a piston slidingly located within the housing, wherein the piston is made of a permanent magnetic material and the piston is to move by magnetic force wherein fluid is to be pumped by the piston.

18 Claims, 9 Drawing Sheets

HIGH EFFICIENCY PUMP FOR LIQUID-COOLING OF ELECTRONICS

BACKGROUND OF THE INVENTION

1. Field of Invention

This invention relates generally to pumps, and more specifically to magnetically driven pumps for cooling electronic equipment and in particular computer systems.

2. Background

Heat generation occurs within an integrated circuit in response to current flow. A computer contains integrated circuits that generate heat while the computer is in an on state. As a computer's central processing unit (CPU) clock frequency has risen, heat generation has also increased. Liquid cooling of a computer system is a highly effective means of removing heat generated by electronic devices such as a computer's CPU. Liquid cooling systems are typically made of a closed fluid loop with a pump to circulate fluid within the loop. Coupled to the loop is a means of transferring heat into the fluid and a means of transferring heat out of the fluid.

What is lacking in the art is a suitable pump for use with electronic devices and in particular computer systems. It is desirable that a pump used in computer system cooling applications be of small volume, on the order of three cubic inches. The pump should have a flow rate between 0.5–1.5 liters/minute, provide a differential pressure of approximately 2 pounds/square inch (psi), provide less than 1 percent failure after 7 years of operation, and emit a sound level that is less than the sound emission provided by the computer system to be cooled.

In addition to these requirements are high efficiency and reliability. Existing diaphragm pumps exhibit problems with noise and reliability. Diaphragms are constantly under a state of stress, which leads to diaphragm failure. Centrifugal pumps are not efficient at low speed and become noisy at high speed with wear increasing as well. Motor driven piston pumps exhibit problems with reliability due to the multitude of moving parts required with these designs. Gear pumps suffer from problems similar to those of centrifugal pumps.

BRIEF DESCRIPTION OF THE DRAWINGS

The present invention is illustrated by way of example and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those skilled in the art to practice the invention. The following detailed description is, therefore, not to be taken in a limiting sense, and the scope of the invention is defined only by the appended claims.

A magnetically driven pump is disclosed for moving liquid in a cooling system. In one embodiment, the cooling system is directed to cooling an electronic device. The magnetically driven pump provides a high pumped volume to displaced volume efficiency by using a dual valve arrangement to pump fluid whenever the pump's piston is in motion. Non-pumping portions of a piston's stroke are eliminated by the valve arrangement and dual fluid chamber configuration. The pump piston is made of a permanent magnetic material and is moved by controlling the magnetic field polarity of an electromagnet surrounding the pump piston.

Figure 1:
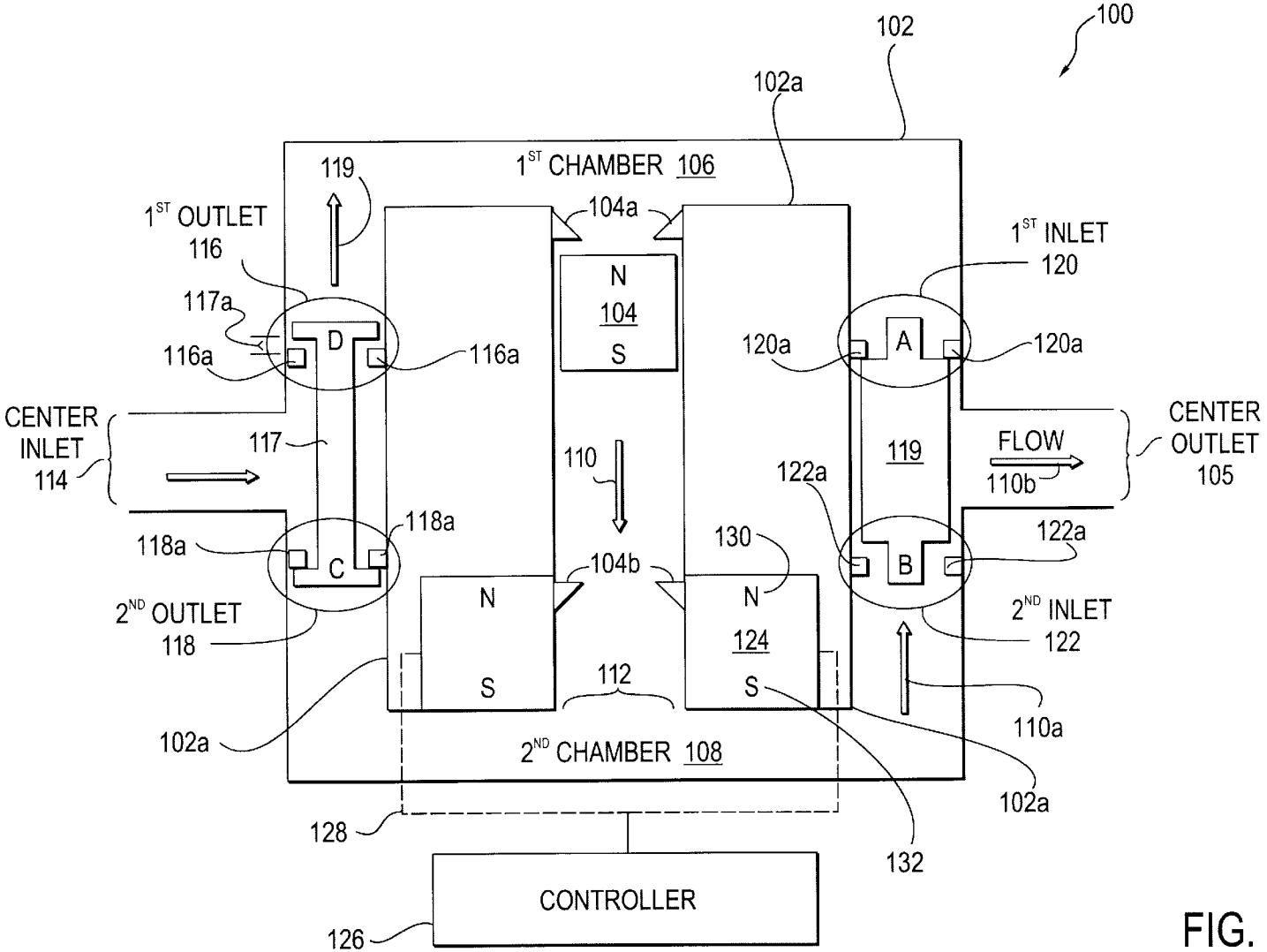
FIG. 1 Illustrates a cross-sectional view of a magnetic pump assembly pumping fluid on a first stroke.
Figure 2:
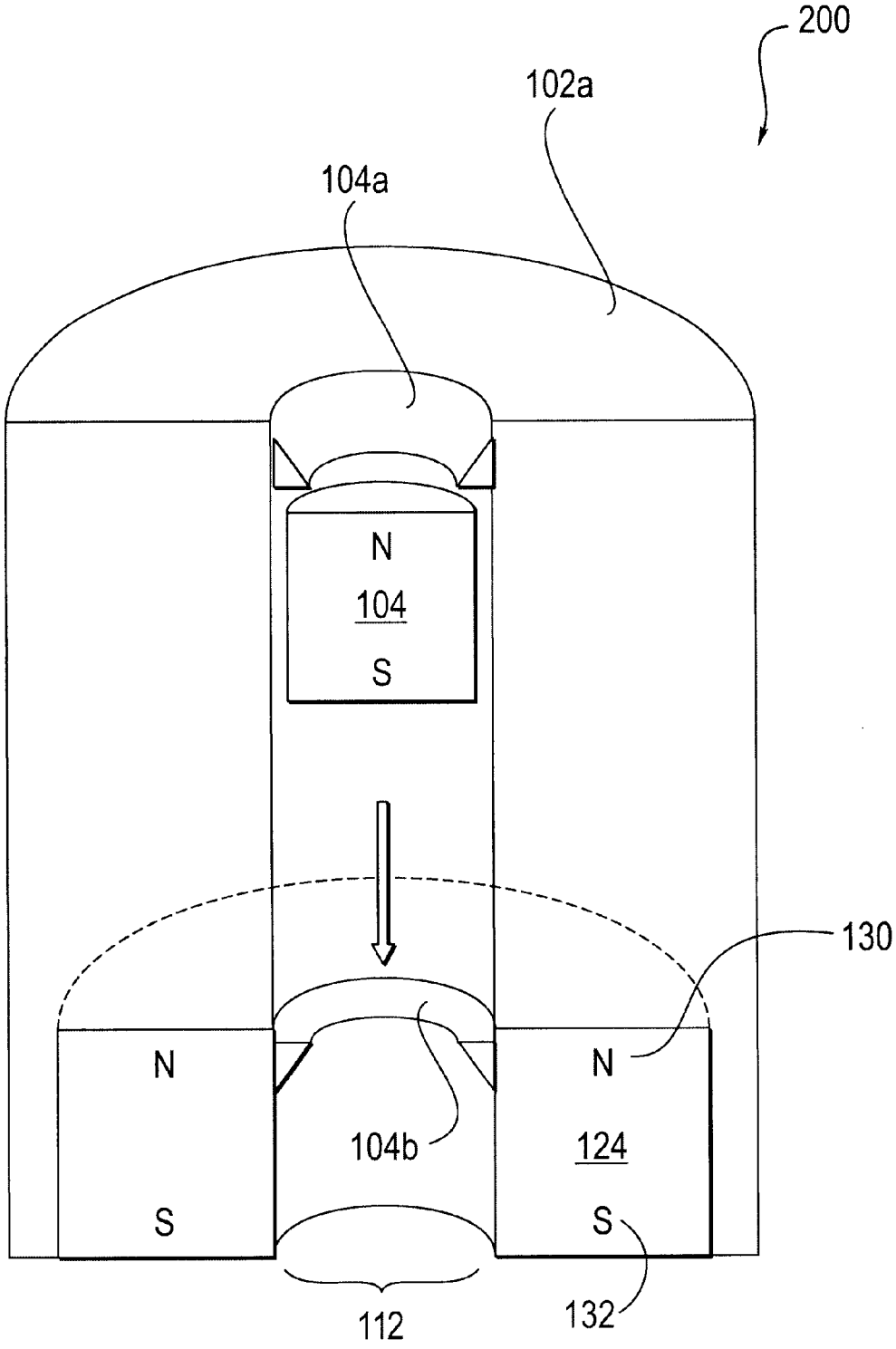
FIG. 2 shows an isometric view of a portion of the assembly shown in FIG. 1.

In one embodiment of the invention, FIG. 1 Illustrates a cross-sectional view of a magnetic pump assembly 100 pumping fluid during a first stroke, indicated by directional arrow 110, of a magnetic piston 104. A chamber 102 (also referred to as a housing) defines a first fluid chamber 106 and a second fluid chamber 108. The magnetic piston 104 separates the fluid chambers. In one embodiment, the magnetic piston 104 moves a distance defined by stops 104*a* and 104*b*. A portion of chamber 102 is indicated by 102*a*, wherein the magnetic piston 104 is slidingly located within a channel 112. The elements displayed in FIG. 1 have an associated area extending into the plane of the figure such that fluid may be displaced by the movement of the magnetic piston 104. In one embodiment, the invention can be made with elements having a circular cross section as can be seen with reference to the isometric view of FIG. 2 at 200. FIG. 2 will be described in a section below.

The magnetic pump assembly 100 has two valves that control the flow of fluid into and out of the $1^{st}$ chamber 106 and the $2^{nd}$ chamber 108. A first valve includes a center inlet 114, where fluid enters, a $1^{st}$ outlet 116, and a $2^{nd}$ outlet 118. Fluid can flow out of either of the $1^{st}$ outlet 116, or the $2^{nd}$ outlet 118 during the operation of the magnetic pump assembly 100. During the phase of pump operation illustrated in FIG. 1, fluid is flowing into the $1^{st}$ chamber 106 through the $1^{st}$ outlet 116 as indicated by arrow 119.

Figure 5:
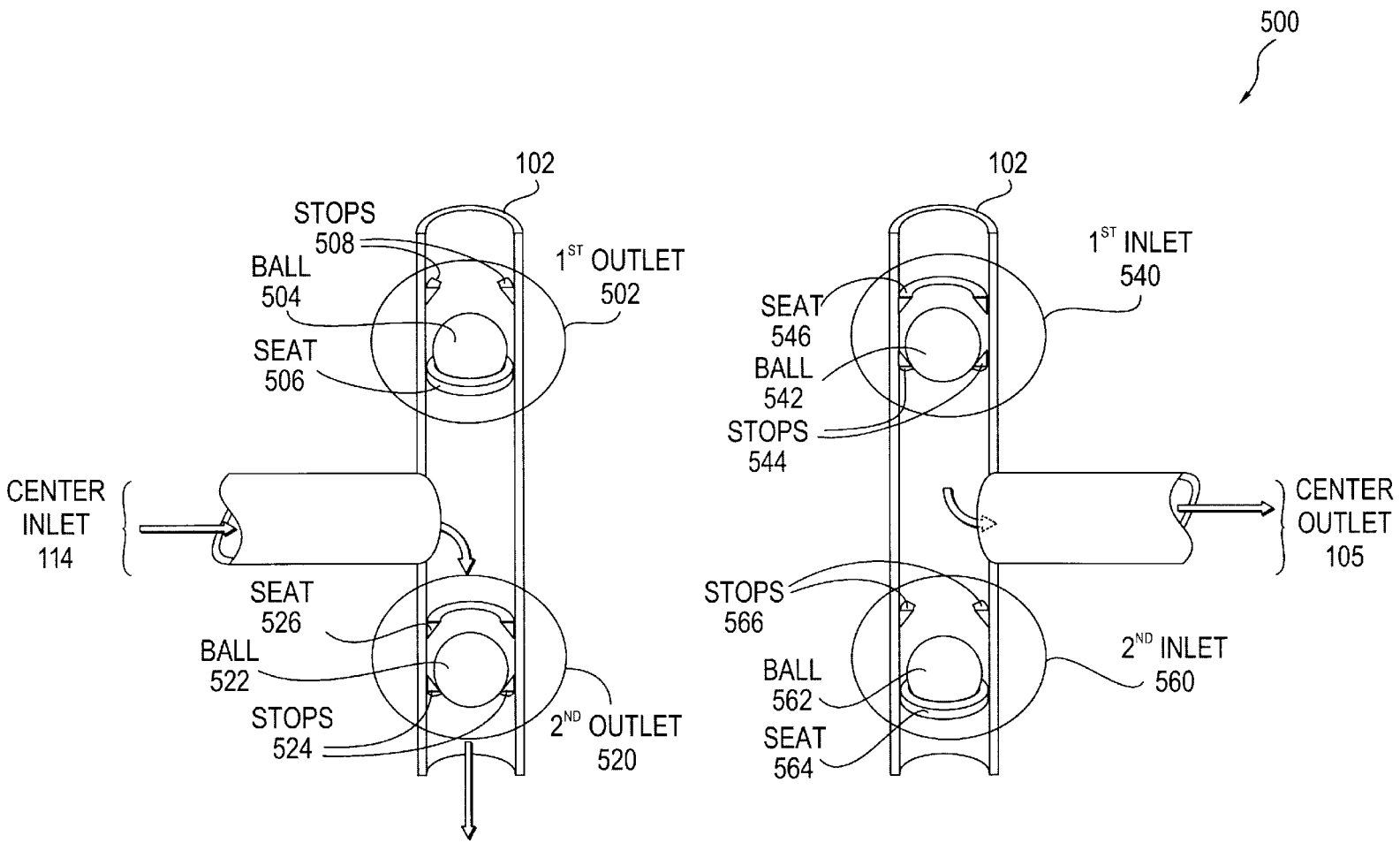
FIG. 5 shows a use of balls in a first valve and a second valve.

Stops 116*a* and 118*a* together with the length of a valve body 117 regulate the amount the $1^{st}$ outlet or the $2^{nd}$ outlet will open. The amount that the $1^{st}$ outlet 116 is open, is indicated by a gap 117*a*. The gap 117*a* can be adjusted depending on the viscosity of the fluid used within the magnetic pump assembly and the cross sectional area provided for fluid flow through the $1^{st}$ outlet 116 and the $2^{nd}$ outlet 118 as is well known in the art. In one embodiment, the combination of the $1^{st}$ outlet 116, the $2^{nd}$ outlet 118 and the valve body 117 is known in the art as a double poppet valve. In alternative embodiments of the invention, the $1^{st}$ outlet 116 and the $2^{nd}$ outlet 118 can be mechanically uncoupled from each other. One such embodiment is illustrated in FIG. 5, which will be described in a latter section. Fluids such as water, oil, glycerin, etc. can be used within the magnetic pump assembly. Other fluids can be used consistent with a particular design for the magnetic assembly.

A second valve includes a center outlet 105, a $1^{st}$ inlet 120, and a second inlet 122. In one embodiment, stops 120*a* and stops 122*a* together with the length of a valve body 119 create a gap for fluid to exit from the $2^{nd}$ chamber 108 out of the magnetic pump assembly 100 through the center outlet 105, as indicated by flow 110*b*. In one embodiment, the valve body 119 can be a modified needle valve as shown in FIG. 1. The type of closure used for the $1^{st}$ inlet 120 or the $2^{nd}$ inlet 122 is not limiting. In another embodiment, a reed valve could be used to control the flow of fluid at the $1^{st}$ inlet 120 and the $2^{nd}$ inlet 122.

The first fluid chamber 106 is defined by the closed interior portion of chamber 102 that extends from the $1^{st}$ outlet 116 to the $1^{st}$ inlet 120 and is adjusted by the position occupied at any instant in time by the magnetic piston 104 and bounded by 102*a*. The second fluid chamber 108 is defined by the closed interior portion of chamber 102 that extends from the $2^{nd}$ outlet 118 to the $2^{nd}$ inlet 122 and adjusted by the position occupied at any instant in time by the magnetic piston 104 and bounded by 102*a*.

With reference back to FIG. 1, the magnetic piston 104 moves in the direction indicated by arrow 110 due to a magnetic force exerted by the attraction of electromagnet 124 and the permanent magnet inherent in the magnetic piston 104. A controller 126 supplies current to the electromagnet 124, via control line 128, such that the north pole, indicated by N at 130 and the south pole indicated by S at 132 are oriented as shown causing attraction to occur. As is well known in the art, opposite magnetic poles attract and like magnetic poles repel each other. Thus, as the magnetic piston 104 moves fluid in the direction indicated by 110, fluid enters the center inlet 114 through the $1^{st}$ outlet 116 and into the $1^{st}$ chamber 106. Simultaneously, fluid is expelled from the $2^{nd}$ chamber 108 by way of the $2^{nd}$ inlet 122 and the center outlet 105.

The shape of the interior surface represented by 102*a* is not constrained to any one shape. However in one embodiment of the invention, a circular shape is displayed in FIG. 2 for ease of discussion. FIG. 2 shows an isometric view 200 of a portion of the assembly shown in FIG. 1. Isometric view 200 illustrates the channel 112 that the magnetic piston moves within. Also indicated in FIG. 2 is the three dimensional nature of the electromagnet 124 and the stops 104*b* and 104*a*. In alternative embodiments, the stops 104*a* and 104*b* need not be continuous with respect to the circumference of the channel, but can extend along a portion of the circumference of the channel. The function of the stops is to limit the distance traveled by the magnetic piston 104. In alternative embodiments, the invention can be configured without stops 104*a* and 104*b*. In such an embodiment the magnetic piston 104 is free to travel from one end of the channel 112 to the other. It will be noted by those skilled in the art that the length of electromagnet 124 and the length of the magnetic piston 104 can be adjusted so that the magnetic piston 124 can be moved by the electromagnet 124 regardless of the location of the magnetic piston 104 within the channel 112.

Figure 3:
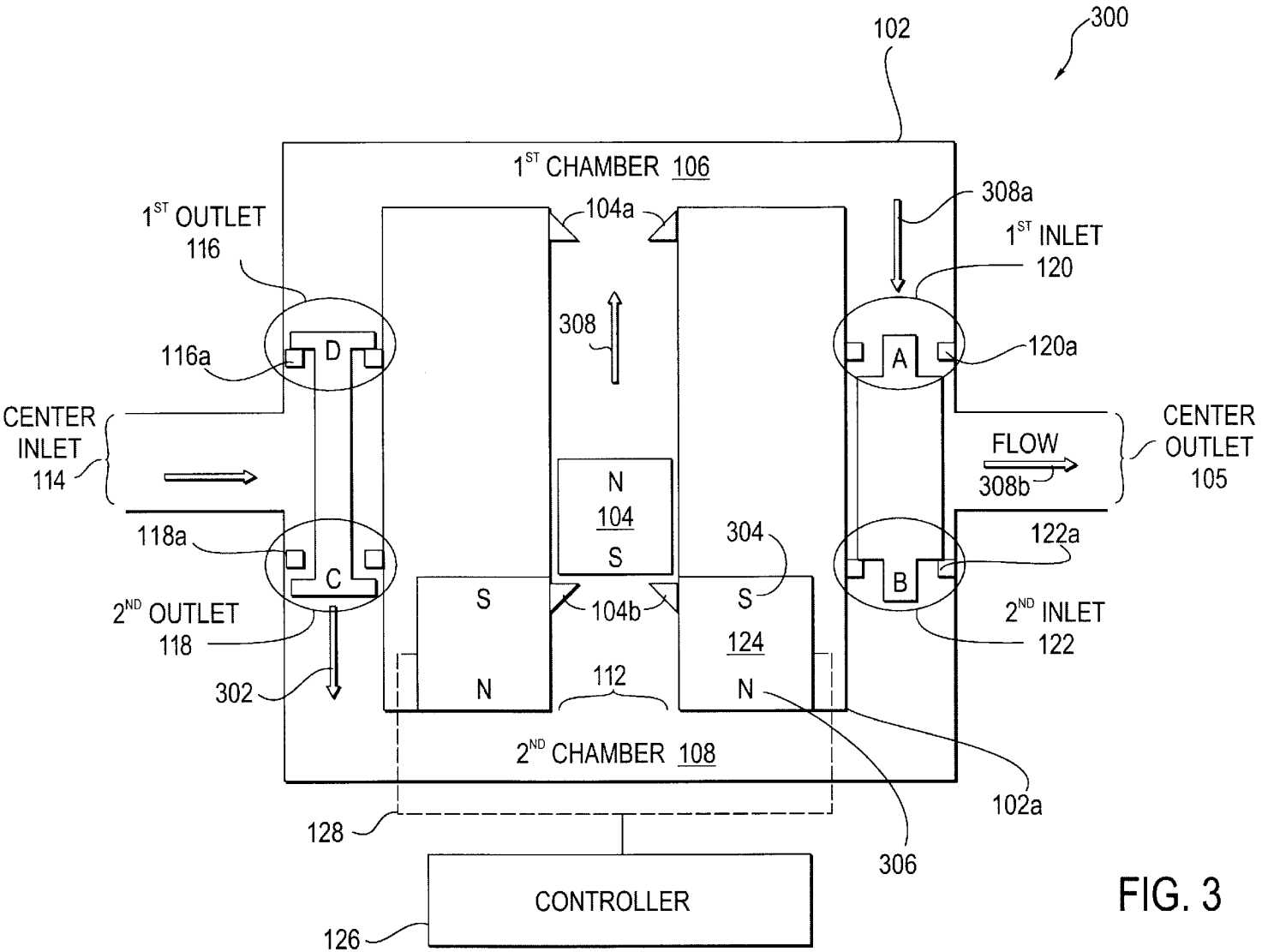
FIG. 3 illustrates a cross-sectional view of the pump-assembly shown in FIG. 1 pumping fluid on a second stroke.

After the first stroke has been completed, which results in the magnetic piston reaching stop 104*b*, the controller 126 reverses the magnetic polarity of the electromagnet 124 as is shown in FIG. 3. FIG. 3 illustrates a cross-sectional view of the pump assembly (shown in FIG. 1) pumping fluid on a second stroke in 300. The reversed magnetic polarity of the electromagnet 124 places the south pole as shown by 304, proximate to the south pole of the magnetic piston (as indicated by the S on the magnetic piston 104) causing the magnetic piston 104 to be propelled by a magnetic force developed between the similar south poles of the two magnets. The north pole of the electromagnet 124 is shown by 306. The resulting motion of the magnetic piston 104 is in the direction indicated by arrow 308.

As the magnetic piston 104 moves in the direction indicated by arrow 308, a low-pressure condition occurs within the $2^{nd}$ chamber 108 due to the motion of the magnetic piston 104. This low-pressure condition causes the $2^{nd}$ inlet 122 to close and the $2^{nd}$ outlet 118 to open, thereby allowing fluid to enter the $2^{nd}$ chamber 108. Occurring concurrently in the $1^{st}$ chamber 106 is a high-pressure condition resulting from the motion of the magnetic piston 104. This high-pressure condition participates in the closure of the $1^{st}$ outlet 116 and the simultaneous opening of the $1^{st}$ inlet 120, which allows fluid to flow out of the center outlet 105 as indicated by 308*a* and flow 308*b*. Thus, during both strokes of the magnetic piston 104, 110 as indicated in FIG. 1, and 308 as indicated in FIG. 3, fluid is drawn into the pump assembly through the center inlet 114 and is expelled from the pump assembly 100 out of the center outlet 105. During the operation of the magnetic pump assembly 300, fluid is pumped alternately from the $1^{st}$ chamber and then from the $2^{nd}$ chamber on a rotating basis.

Figure 4:
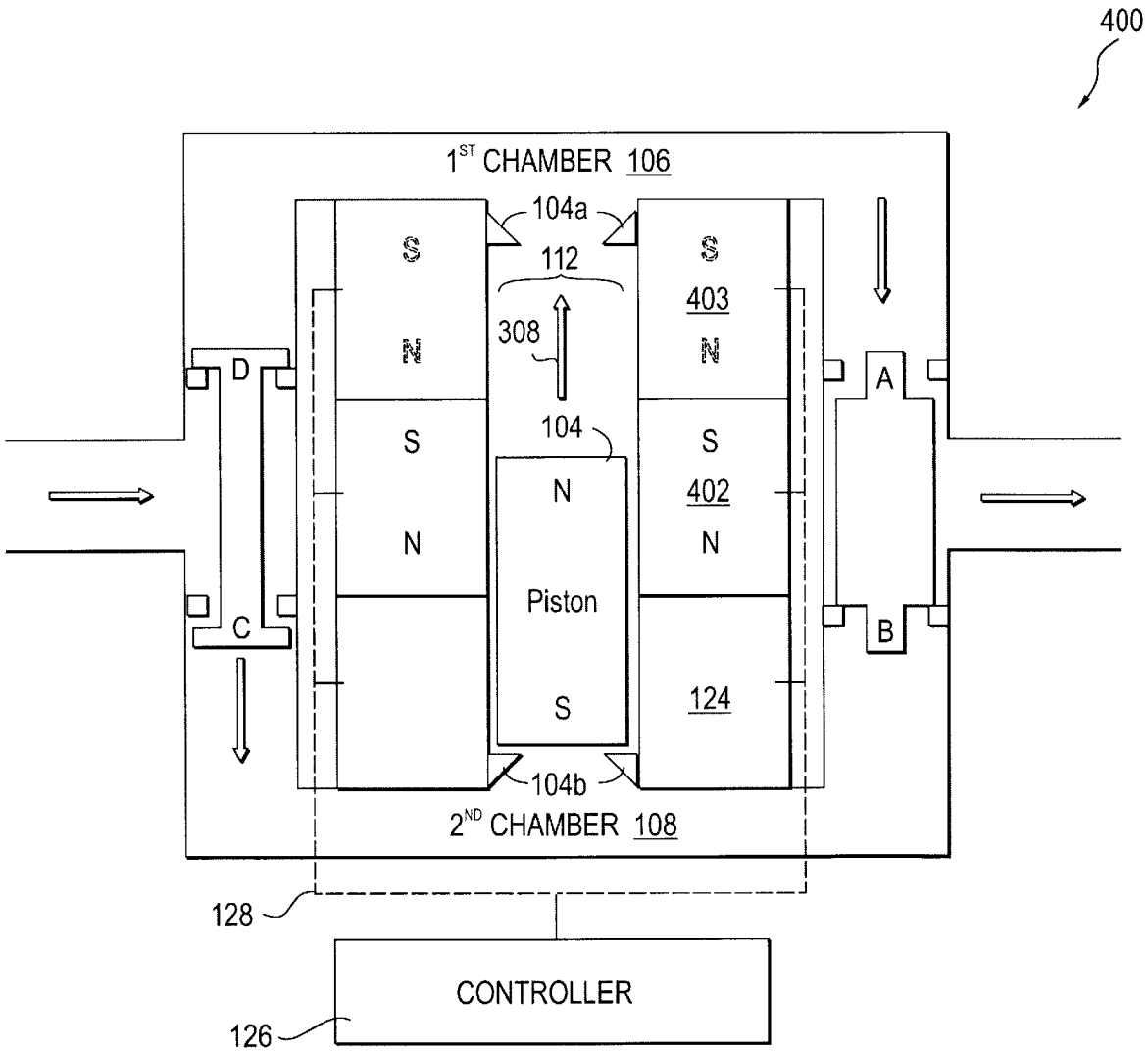
FIG. 4 illustrates an embodiment of a pump assembly using a plurality of magnets.

In alternative embodiments, a plurality of electromagnets can be used to move the magnetic piston 104 through the channel 112. FIG. 4 illustrates an embodiment of a pump assembly, shown at 400, where the controller 126 is connected to three electromagnets magnets 124, 402, and 403. The controller 126 functions similarly to a controller used in a brushless direct current (DC) motor controller except that the motion is linear rather than circular as in the brushless DC motor application. In one embodiment, the controller performs a combination of the previously described magnetic polarity reversal within the electromagnets by reversing the direction of current flow and switching the current on and off between electromagnets. With reference to FIG. 4, the controller 126 is supplying current to the electromagnet 402, which creates the magnetic polarity shown with the designations S and N. The magnetic force resulting from the interaction of the electromagnet 402 and the magnetic piston 104 works to move the magnetic piston 104 in the direction of arrow 308 and will continue to move the magnetic piston 104 in that direction until the magnetic center of the electromagnet 402 and the magnetic center of the magnetic piston 104 are aligned. The current between the electromagnets is caused to change as a function of time by the controller 126 to continue to move the magnetic piston 104 in the direction indicated by arrow 308. Once the magnetic centers of the electromagnet 402 and the magnetic piston 104 are aligned, further magnetic force is achieved by turning off current flow to the electromagnet 402 and turning on current flow to the electromagnet 403 with the magnetic polarity of electromagnet 403 indicated with the dashed S and N. The polarity indicated on electromagnet 403 provides a magnetic force of attraction to pull the magnetic piston 104 until the magnetic centers of electromagnet 403 and the magnetic piston 104 become aligned. In alternative embodiments, other control algorithms may be employed to utilize more then one electromagnet at a time in order to move magnetic piston 104 through channel 112.

For example, as the controller 126 switched current from the electromagnet 402 to the electromagnet 403, after a time delay, current can be reversed and turned back on to electromagnet 402. Doing so will cause electromagnet 402 to repel the magnetic piston 104 while electromagnet 403 is attracting the magnetic piston 104. This method of control can provide greater pumping pressure due to the increased magnetic force exerted by two electromagnets being used concurrently. Many other control algorithms that are used in the art may be employed to move the magnetic piston 104. Many other designs of the outlets 116, 118 and the inlets 120, and 122 are contemplated for use herein. For example, mechanical decoupling can occur within the valve body 117 and the valve body 119 without adverse impact on the flow of fluid through the pump.

FIG. 5 shows a use of independent balls in place of the double-ended poppet and modified needle valve used in FIGS. 1–4. In the alternative embodiment shown in FIG. 5 at 500, the $2^{nd}$ outlet 118 and stop 118*a* of FIGS. 1–4 is replaced with a second outlet 520. The second outlet 520 includes a ball 522 which can move between stops 524 and seat 526. The configuration illustrated in FIG. 5 is consistent with the pump stroke shown in FIG. 3 with 308 indicating the direction the magnetic piston 104 is moving. With respect to FIG. 5, fluid is entering center inlet 114 and being drawn past the ball 522 as it rests on the stops 524. Thus, fluid is flowing out of the $2^{nd}$ outlet 520 and into the $2^{nd}$ chamber 108 (not indicated on FIG. 5). In a similar arrangement a $1^{st}$ outlet 502 includes a ball 504 which can move between stops 508 and a seat 506. Due to the high-pressure condition in the $1^{st}$ chamber 106, the ball 504 is pressed against the seat 506, thus fluid cannot flow past the $1^{st}$ outlet 502.

A second valve includes center outlet 105 and $1^{st}$ inlet 540 and $2^{nd}$ inlet 560. The $1^{st}$ inlet 540 includes a ball 542, a seat 546, and stops 544. Similarly the $2^{nd}$ inlet 560 includes a ball 562, a seat 564, and stops 566. During the pump stroke shown in FIG. 3, fluid is flowing out of the $1^{st}$ inlet 540 and out of the pump assembly by way of the center outlet 105 (as was described in conjunction with FIG. 3). The high-pressure condition in the $1^{st}$ chamber relative to the $2^{nd}$ chamber ensures that the ball 562 rests against the seat 564, thus closing off fluid flow through the $2^{nd}$ outlet 560 which is necessary in order for the $2^{nd}$ chamber to fill with fluid entering by the $2^{nd}$ outlet 520.

In an alternative embodiment of the invention, other valve types can be substituted for those described herein. For example, poppet valves, needle valves, and ball type check valves have been described in the preceding figures. In various embodiment, a floating disk valve, a reed valve, and a needle valve or a combination of valve types can be used to regulate fluid flow across the $1^{st}$ outlet, $2^{nd}$ outlet, $1^{st}$ inlet, and the $2^{nd}$ inlet. The type of valve mechanism is not limiting.

It will be noted by those of skill in the art that the magnetic pump 100 contains few moving parts, principally the magnetic piston 104 and the mechanisms used in the first valve and the second valve. In one embodiment, the magnetic piston 104 can be made with an outer surface of titanium nitride coated on ceramic. Such a surface provides minimum wear between moving parts. In one embodiment of a pump designed to produce a flow rate of 500 milliliters/minute, approximately six pump cycles per second would be required. This calculation is based on a pump volume of 1 cubic centimeter and an efficiency of 75%. The pump volume is the volume displaced by the magnetic piston 104 during one stroke of motion. 75% efficiency is a reasonable quantity for a close sliding fit design between the magnetic piston 104 and the channel 112 without using piston rings. Many other pump designs are possible, the present invention is not limited by thereby. In an alternative embodiment, it may be desirable to use multiple pistons and/or multiple channels 112 through which the pistons move in order to create different flow rates and/or pump operating pressures.

Figure 6:
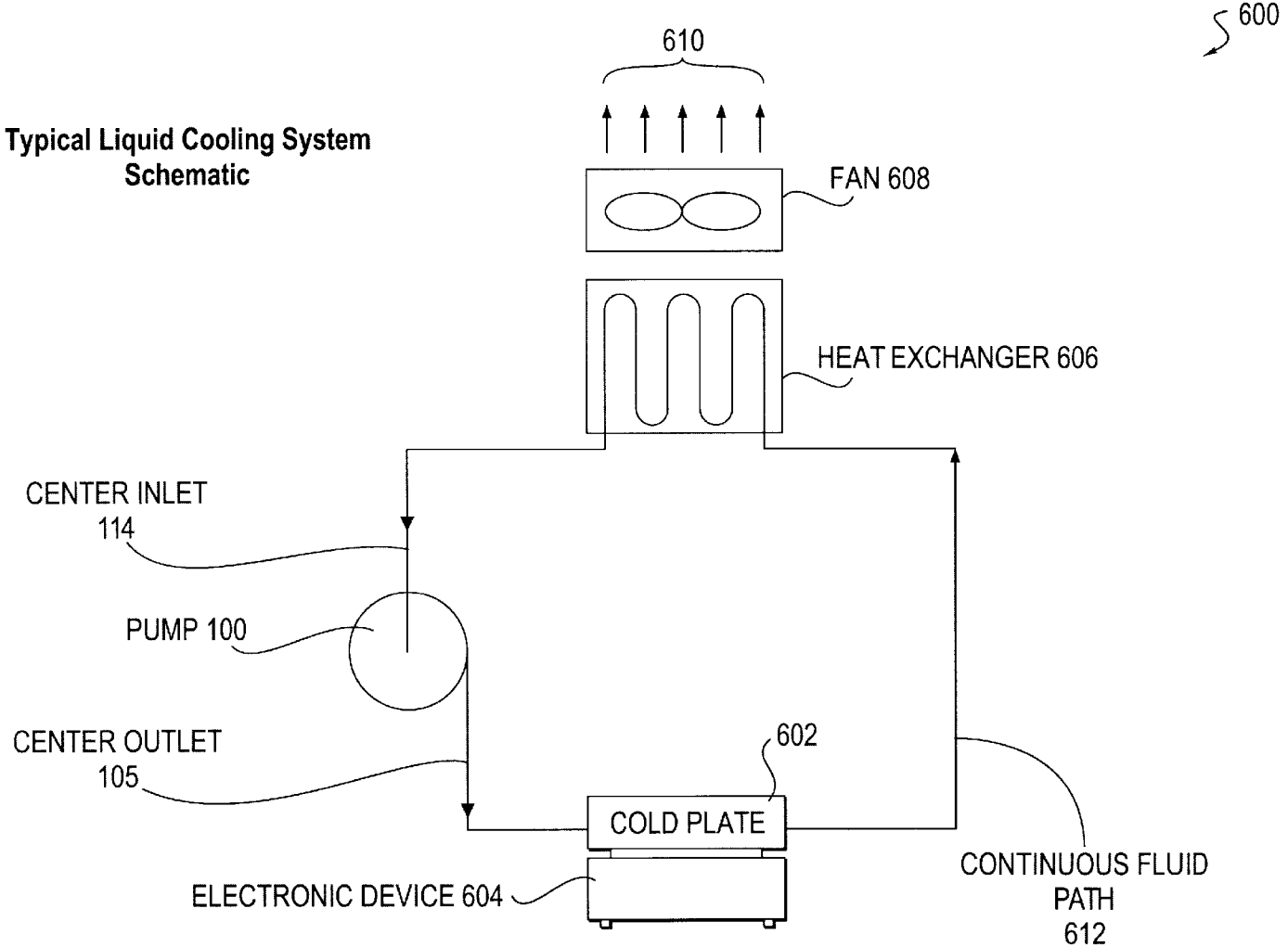
FIG. 6 illustrates a use of a magnetic pump assembly in a cooling system for an electronic device.

The magnetic pump 100 can be used to pump water within a closed loop cooling system. FIG. 6 illustrates a use of a magnetic pump assembly in a cooling system for cooling an electronic device as shown at 600. With reference to FIG. 6, the magnetic pump 100 is connected to a continuous fluid path 612. The magnetic pump 100 provides for fluid intake at the center inlet 114 and expels fluid at the center outlet 105. Fluid flows into a cold plate 602 and removes heat from an electronic device 604. Removing heat from the electronic device 604 elevates the temperature of the fluid. As the fluid is pumped around the continuous fluid path 612, heat is removed from the fluid in a heat exchanger 606. Removal of heat can be enhanced in an embodiment of the invention by using a fan 608 to move air 610 across the heat exchanger 606.

Figure 7:
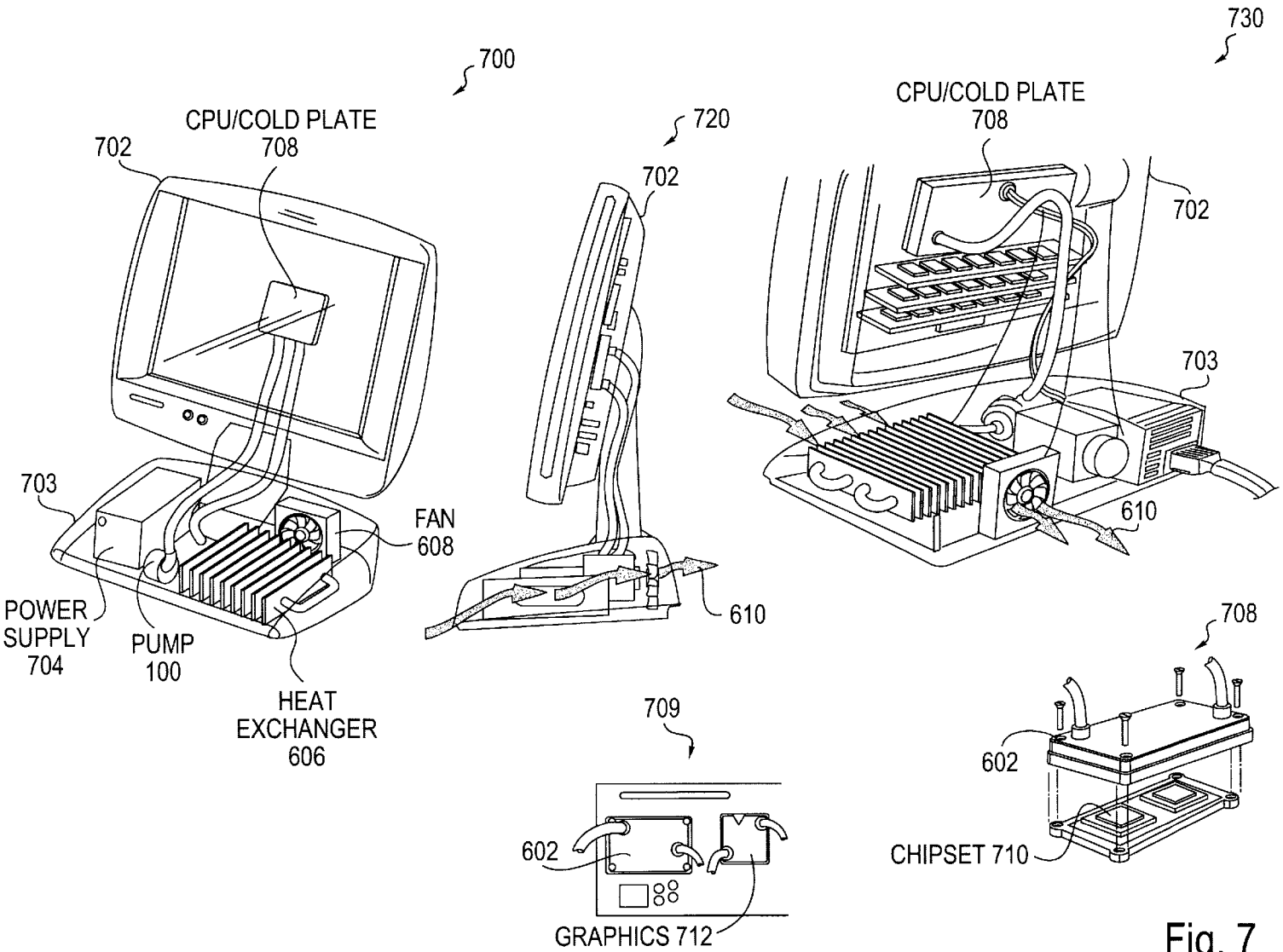
FIG. 7 shows a use of a magnetic pump assembly in a desktop computer system.

FIG. 7 shows a use of a magnetic pump assembly in a desktop computer system. The cooling system described in conjunction with FIG. 6, can be used to remove heat from electronic devices used in a computer system as shown in FIG. 7. With reference to FIG. 7, a front view of a desktop computer is shown at 700. The desktop computer can include an information display 702, a container 703 to house the magnetic pump 100, a power supply 704, the heat exchanger 606, and the fan 608. The electronic device 604 can be a central processing unit or other heat generating integrated circuit as shown in 708 as chipset 710 or graphics 712. For ease of illustration, the combination of the cold plate 602 and heat generating electronic device is indicated as CPU/Cold Plate 708. A side view of a desktop computer is shown at 720. Air flow 610, created by fan 608, is illustrated moving across heat exchanger 606 in the side view 720 and in a back view 730. A power supply 704 can be located within the container 703. In one embodiment of the invention, within the information display 702, (not shown) is a system bus coupled with the CPU/Cold Plate.

In various embodiments of the invention, several cold plates can be used to remove heat from electronic devices that are separate from each other. Such an example is seen in 709 where two separate cold plates are used indicated by 602 and 712.

Figure 8:
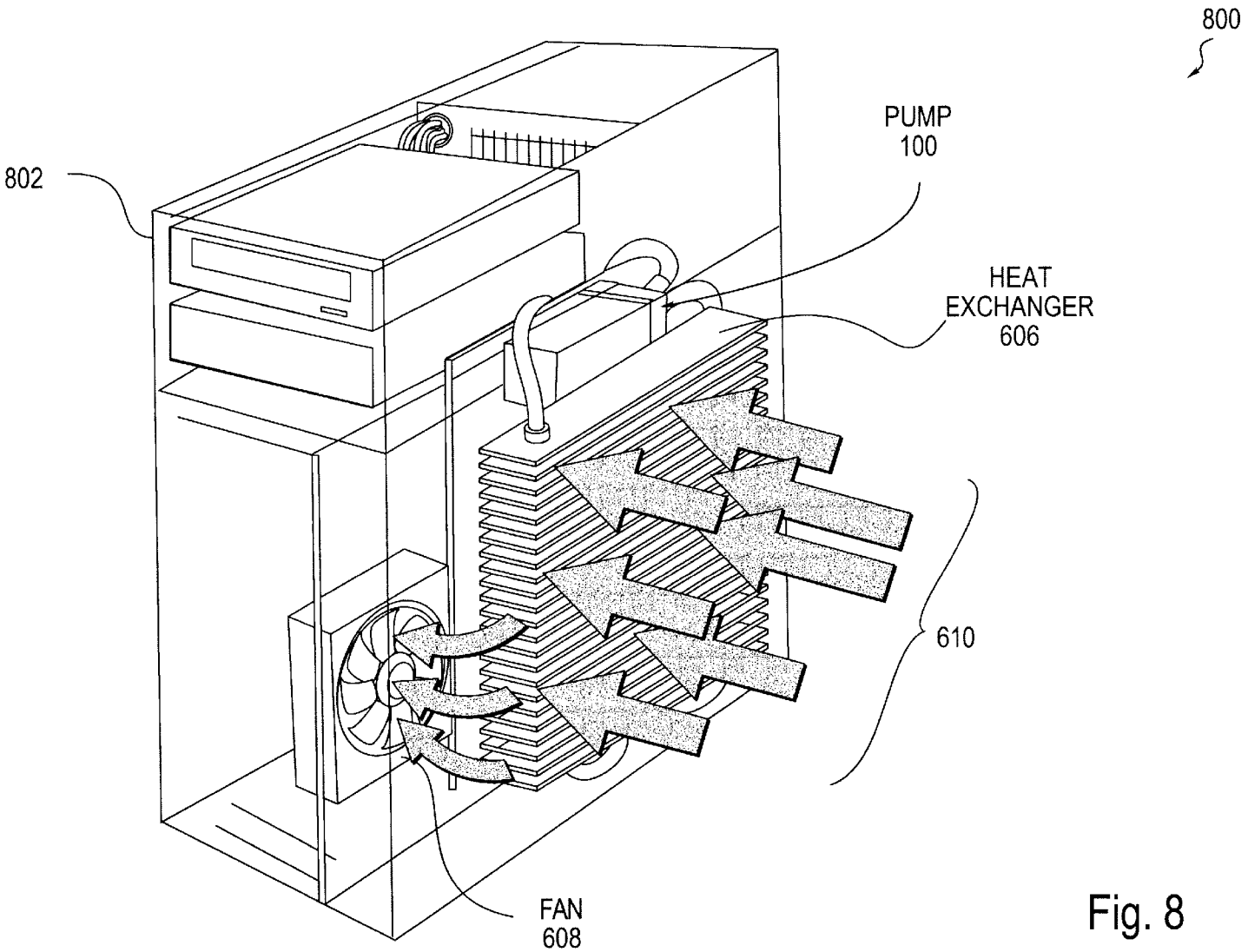
FIG. 8 illustrates a use of a magnetic pump assembly built into a computer cabinet.

FIG. 8 illustrates a use of a magnetic pump 100 with the cooling system of FIG. 6 built into a computer cabinet, as shown at 800. Such a computer configuration can be referred to in the art, but not limited to, a desk side computer or a server. With reference to FIG. 8, computer cabinet 802 can house the components described in conjunction with the container 703 (FIG. 7). For example, in one embodiment of the invention, the computer cabinet 802 (FIG. 8) can contain the following components from FIG. 7, chipset 710, the graphics 712, the system bus (not shown), the power supply 704, the heat exchanger 606, the fan 608, and the CPU/Cold Plate 708.

Figure 9:
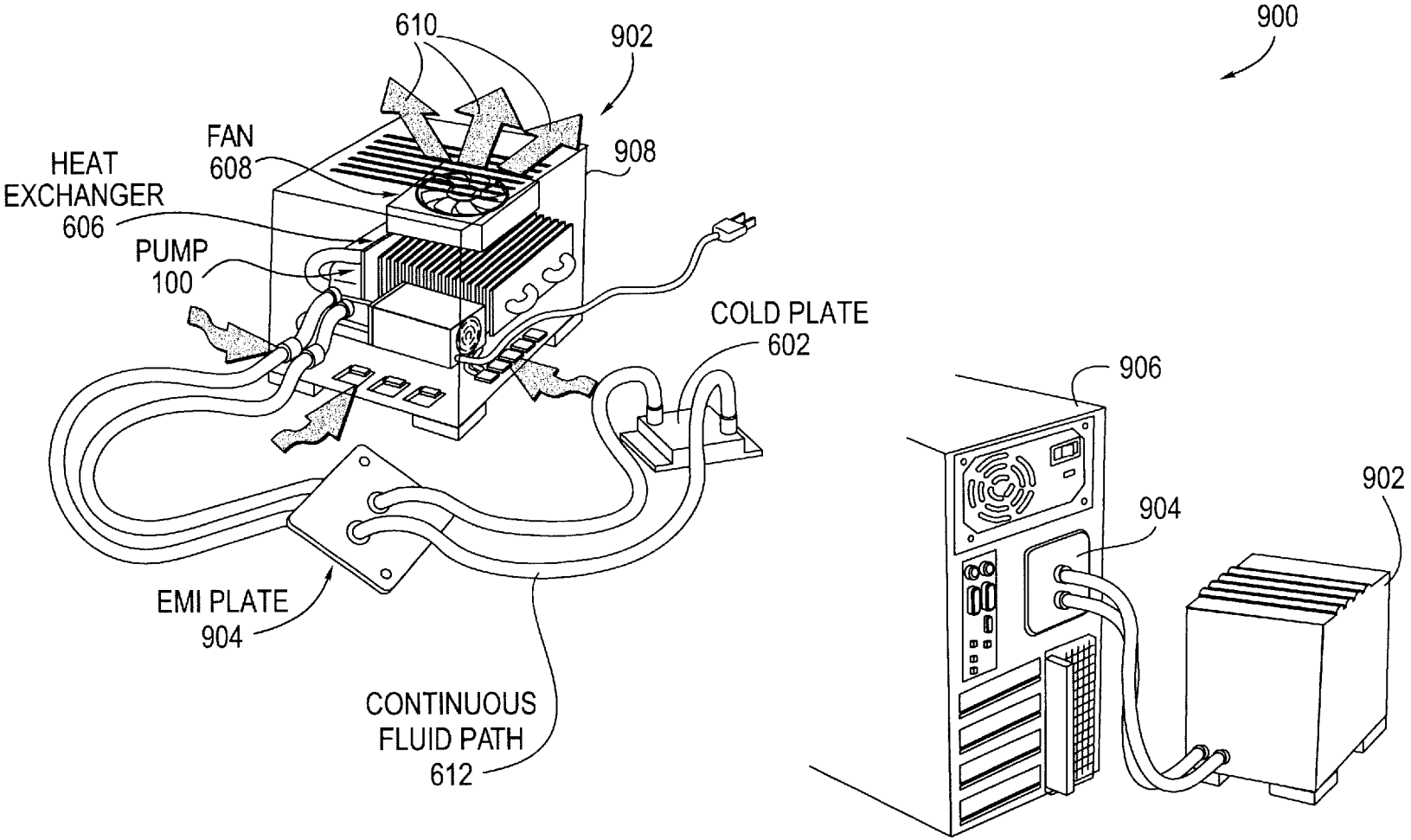
FIG. 9 shows a use of a magnetic pump assembly external to a computer cabinet.

In alternative embodiments, the invention can be configured external to the container 703 or the cabinet 802. FIG. 9 shows a use of a magnetic pump assembly 902 external to a computer cabinet 906, as shown at 900. The magnetic pump assembly 902 can be divided up and separated as shown in FIG. 9, where cold plate 602 is external to the components arranged in a housing 908. The cold plate 602 can be installed internal to the computer cabinet 906, proximate to an electronic device that generates heat such as a CPU or graphics chip or chip set. Magnetic pump 100 circulates fluid through the continuous fluid path 612 to remove heat from the electronic device as was described in conjunction with FIGS. 6–8. Many other embodiments of the invention are possible and contemplated within this detailed description.

It will be appreciated that the methods described in conjunction with the figures may be embodied in machine-executable instructions, e.g. software. The instructions can be used to cause a general-purpose or special-purpose processor that is programmed with the instructions to perform the operations described. Alternatively, the operations might be performed by specific hardware components that contain hardwired logic for performing the operations, or by any combination of programmed computer components and custom hardware components. The methods may be provided as a computer program product that may include a machine-readable medium having stored thereon instructions which may be used to program a computer (or other electronic devices) to perform the methods. For the purposes of this specification, the terms "machine-readable medium" shall be taken to include any medium that is capable of storing or encoding a sequence of instructions for execution by the machine and that cause the machine to perform any one of the methodologies of the present invention. The term "machine-readable medium" shall accordingly be taken to included, but not be limited to, solid-state memories, optical and magnetic disks, and carrier wave signals. Furthermore, it is common in the art to speak of software, in one form or another (e.g., program, procedure, process, application, module, logic . . . ), as taking an action or causing a result. Such expressions are merely a shorthand way of saying that execution of the software by a computer causes the processor of the computer to perform an action or a produce a result.

Thus, a novel magnetically driven pump is described. Although the invention is described herein with reference to specific preferred embodiments, many modifications therein will readily occur to those of ordinary skill in the art. Accordingly, all such variations and modifications are included within the intended scope of the invention as defined by the following claims.

What is claimed is:

1. An apparatus comprising:

a first single poppet valve having a center inlet, a first outlet and a second outlet, said outlets are opened in opposite direction and a valve body having an adjustable gap said, center inlet being disposed between said first outlet and said second outlet;

a second single poppet valve having a center outlet, a first inlet and a second inlet, said inlets are opened in opposite direction and a valve body having an adjustable gap, said center outlet being disposed between said first inlet and said second inlet;

a first chamber formed between the first outlet and the first inlet wherein fluid is communicatively coupled; and a second chamber formed between the second outlet and the second inlet wherein fluid is communicatively coupled and wherein fluid is to be pumped out of the center outlet from the first chamber and then fluid is to be pumped out of the center outlet from the second chamber.

2. The apparatus of claim 1, further comprising:

an enclosure; and a piston having a first stroke and a second stroke, the piston slidingly located within the enclosure, wherein fluid is to be pumped out of the first chamber during the first stroke and fluid is to be pumped out of the second chamber during the second stroke.

3. The apparatus of claim 2, further comprising:

a cold plate coupled with the fluid;

an electronic device coupled with the cold plate, the electronic device to generate heat; and a heat exchanger coupled with the fluid and the cold plate to form a continuous fluid path, wherein the piston is to pump fluid around the continuous fluid path and the fluid is to remove heat from the cold plate wherein the electronic device is to be cooled.

4. The apparatus of claim 3, wherein the electronic device is an integrated circuit.

5. The apparatus of claim 4, further comprising:

a container to house the integrated circuit;

a system bus within the container; and an electrical power supply within the container, to supply electrical power to the integrated circuit wherein heat is to be generated by the integrated circuit and is to be removed by the fluid.

6. The apparatus of claim 5, further comprising:

an information display coupled with the system bus and the integrated circuit, the information display is to display information to be viewed by a user.

7. The apparatus of claim 1, wherein a first stroke of the piston is to cause fluid entering the center inlet to exit the second outlet and fill the second chamber.

8. The apparatus of claim 1, wherein a second stroke of the piston is to cause fluid entering the center inlet to exit the first outlet and fill the second chamber.

9. The apparatus of claim 1, wherein the first valve is selected from the group consisting of a double poppet valve and a double modified needle valve.

10. The apparatus of claim 1, wherein the first outlet is selected from the group consisting of a poppet valve, a needle valve, a ball valve, a floating disk valve, and a reed valve.

11. The apparatus of claim 1, wherein the second outlet is selected from the group consisting of a poppet valve, a needle valve, a ball valve, a floating disk valve, and a reed valve.

12. The apparatus of claim 1, wherein the valve is selected from the group consisting of a double poppet valve and a double modified needle valve.

13. The apparatus of claim 1, wherein the first inlet is selected from the group consisting of a poppet valve, a needle valve, a ball valve, a floating disk valve, and a reed valve.

14. The apparatus of claim 1, wherein the second inlet is selected from the group consisting of a poppet valve, a needle valve, a ball valve, a floating disk valve, and a reed valve.

15. A method comprising:

filling a second chamber of a pump assembly with fluid, wherein the second chamber is formed between a second outlet of a first single poppet valve, a first inlet of a second single poppet valve, and a piston by the movement of the piston during a first stroke, wherein the first single poppet valve has a center inlet, a first outlet and a second outlet, said outlets are opened in opposite direction and a valve body having an adjustable gap, said center inlet being disposed between said first outlet and said second outlet, and a second single poppet valve having a center outlet, a first inlet and a second inlet, said inlets are opened in opposite direction and a valve body having an adjustable gap, said center outlet being disposed between said first inlet and said second inlet;

expelling fluid from a first chamber of the pump assembly, wherein the first chamber is formed between the first outlet, the first inlet, and the piston by the movement of the piston during the first stroke.

16. The method of claim 15, wherein the first stroke of the piston is to cause fluid entering the center inlet to exit the second outlet and fill the second chamber.

17. The method of claim 15, further comprising:

filling the first chamber of the pump assembly with fluid, wherein the first chamber is formed between the first outlet of the first valve, the first inlet of the second valve, and the piston by the movement of the piston during a second stroke; and expelling fluid from the second chamber of the pump assembly, wherein the second chamber is formed between the second outlet, the second inlet, and the piston by the movement of the piston during the second stroke.

18. The method of claim 17, wherein the second stroke of the piston is to cause fluid entering the center inlet to exit the fist outlet and fill the first chamber.

* * * * *